United States Patent [19]

Maguire

[11] 4,079,472

[45] Mar. 21, 1978

[54] SLEEPING BAG

[76] Inventor: Sara Barbara Maguire, 1952 Port Provence Pl., Newport Beach, Calif. 92660

[21] Appl. No.: 697,420

[22] Filed: Jun. 18, 1976

[51] Int. Cl.[2] ..... A47G 9/00

[52] U.S. Cl. ..... 5/343

[58] Field of Search ..... 5/343

[56] References Cited

U.S. PATENT DOCUMENTS

| | | | |
|---|---|---|---|
| 831,733 | 9/1906 | Moore | 5/343 |
| 1,284,046 | 11/1918 | Blocksom | 5/343 |
| 1,885,558 | 11/1932 | Smith | 5/343 |
| 2,133,717 | 10/1938 | Robes | 5/343 |
| 3,003,164 | 10/1961 | Calvelage | 5/343 |

FOREIGN PATENT DOCUMENTS

| | | | |
|---|---|---|---|
| 487,332 | 4/1918 | France | 5/343 |
| 23,220 | 11/1898 | United Kingdom | 5/343 |
| 1,266,559 | 3/1972 | United Kingdom | 5/343 |

*Primary Examiner*—Paul R. Gilliam
*Assistant Examiner*—Victor N. Sakran
*Attorney, Agent, or Firm*—Ben E. Lofstedt

[57] ABSTRACT

A sleeping bag having a pillow pocket at the head thereof, a bag portion extending along less than one-half the length of the sleeping bag, and a foot portion having a longitudinally extensible and laterally expandable section within the bag portion of the sleeping bag.

1 Claim, 5 Drawing Figures

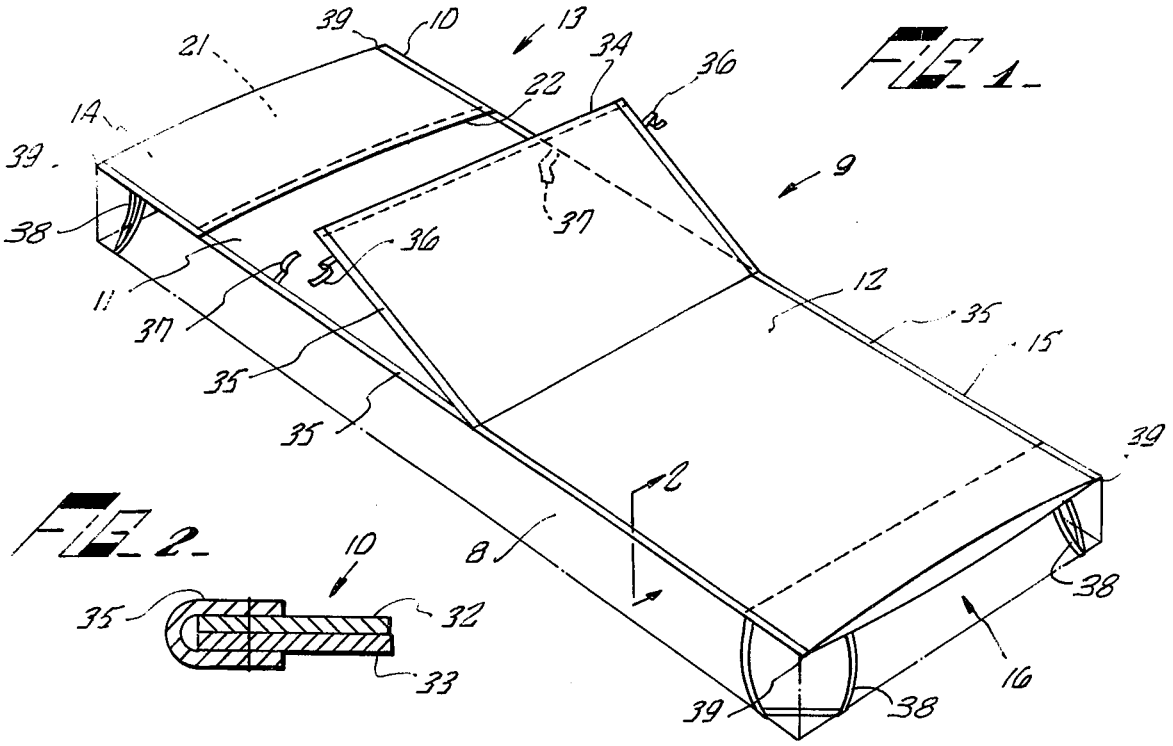
FIG. 1
FIG. 2
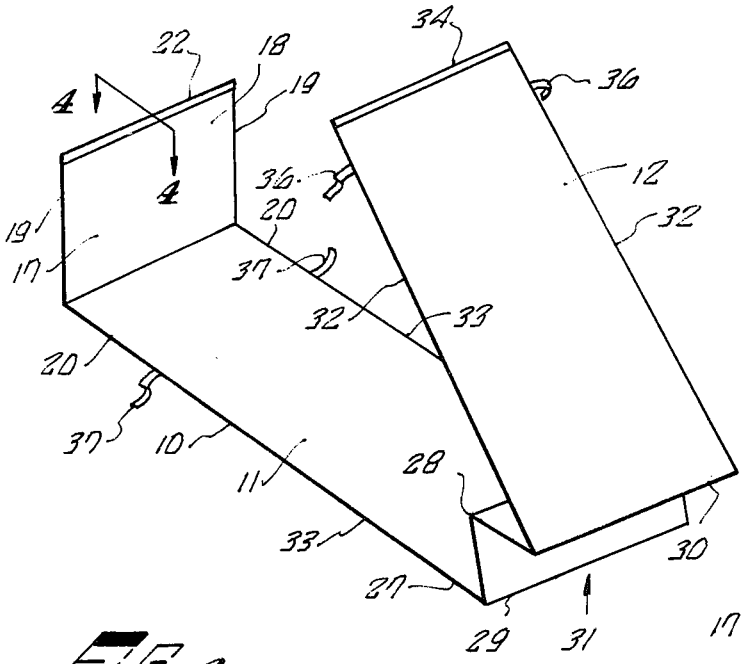
FIG. 3
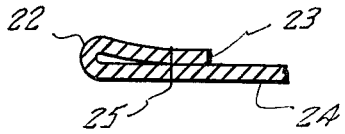
FIG. 4
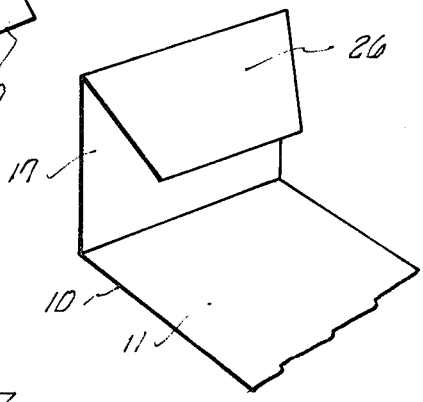
FIG. 5

SLEEPING BAG

BACKGROUND OF THE INVENTION

1. Field of the Invention

The present invention relates to sleeping bags and the like, and more particularly, to a novel and improved sleeping bag adapted especially for use in combination as a removable sanitary sleeping bag liner or alone for, although not necessarily limited to, indoor use.

2. Description of the Prior Art

Sleeping bags found in the prior art have been widely used in a number of different ways and in numerous applications.

One of the many applications includes the use of a such a bag as a simple, low cost, sanitary and protective liner for more elaborate and expensive sleeping bags, such as disclosed in U.S. Pat. No. 2,379,416 (Clark).

Another use for such sleeping bags is found in U.S. Pat. No. 2,972,757 (Adrian) where it is removably secured to a comforter as a sanitary and protective cover or liner.

Sleeping bags such as exemplified by these prior art patents are primarily constructed for out-of-doors camping. Accordingly, such sleeping bags are constructed with special bulky materials to retain body warmth and of relatively rough-to-the-touch fabrics to withstand heavy abuse and are expensive. Because of this expensive form of construction and the unitary size thereof, when cleaning is required, the sleeping bag must be dry cleaned. Such dry-cleaning cannot be accomplished in the simple environment of the home because of the hazardous chemicals used in the dry-cleaning process. Further, dry-cleaning is expensive and time-consuming and, as such, is inconvenient. Further, use of the rough, long-wearing fabrics is not comparable to the relative softness of percale-type fabrics which are typically employed in the making of the finer quality bed sheets.

To significantly reduce this inconvenience and expense, a simple, bag-type protective liner constructed of a bed-sheet is sometimes placed inside the more rugged sleeping bag. Such protective liners not only act to protect the inside of the sleeping bag and may be constructed relatively inexpensively of the more comfortable bed-sheet fabrics but may be periodically removed and conveniently washed in a washing machine.

A further use is taught by U.S. Pat. No. 2,239,017 (Roberts) wherein such a sleeping bag may be used as a sanitary covering for a bed having particular utility for use with babies or young children to keep them fully covered.

As clearly identified by these sleeping bags, sanitation and convenience are important and desirable characteristics of such items.

One of the problems encountered with prior art sleeping bags is that the sanitary liner fails to include a means for also protecting the pillow in a like sanitary fashion as the bed or sleeping bag.

Another difficulty frequently exhibited by sleeping bags of the prior art variety is that the bottom of the bay where the feet are to be placed is uncomfortably confining to the user's feet.

Another limitation experienced in the use of previous bags is that such bags fail to incorporate a means whereby the lenght of the sleeping bag is extensible to permit use by a slight taller person.

Modernly, use of sleeping bags has found wide spread use in conjunction with various recreational vehicles, such as motor homes, trailers and the like. Prior art bags open only along one side of the bag to permit ingress and egress therefrom. When a sleeping bag is used on a bed or bunk in such a recreational vehicle, the bag may open along the wrong side of the bed such as the side of the bed facing the wall of the recreational vehicle. Or the bag, perhaps, has failed to incorporate means for removably securing or lashing the sleeping bag to the mattress of the bed upon which it rests.

The inventor herein, after a considerable amount of time, research and experimentation, has devised a sleeping bag of the type characterized and described herein to overcome the significant disadvantages such as found in the use of these prior art sleeping bags.

SUMMARY OF THE INVENTION AND OBJECTS

The present invention disclosed herein basically comprises a sleeping bag constructed of a single rectangularly-shaped sheet of bed-sheet fabric having an accordian fold at the foot thereof, to permit the foot to be longitudinally extensible to permit the length of the bag to be comfortably utilized by a slightly taller person and laterally expandable to loosely enclose the user's feet. The single sheet of material is further formed to include a top sheet portion and a bottom sheet portion. The top and bottom sheets are joined together along the side edges from the foot up to a point approximately three-eighths of the length of the sleeping bag to form a bag to house the lower torso of the person using the bag and to permit rapid and unfettered ingress and egress from either side of the bag.

The head of the sleeping bag is folded transversely so that the transverse edge of the head faces the center of the sleeping bag. The outwardly facing side edges are thereafter joined to form a pocket for housing a pillow.

Elastic loops joined along the adjacent sides of the bag and extending diagonally across each of the four corners of the underside of the bottom sheet portion of the sleeping bag permit the sleeping bag to be removably secured about the corresponding four corners of a mattress.

It is an important object of the present invention to provide a sleeping bag of the type herein characterized which is constructed of a simple and continuous sheet of fabric.

Another important and primary object of the instant invention is to provide a sleeping bag with a means whereby the foot of the bag portion is longitudinally extensible to permit a taller person to comfortably use the sleeping bag.

A yet still further and basic object of the invention is to provide a sleeping bag having a laterally expandable foot portion to contain the feet of the user without uncomfortable confinement thereof.

It is yet a still further and important object of the instant invention to provide a sleeping bag with longitudinally arranged openings for simple and convenient ingress and egress to the bag portions of the sleeping bag from either side of the sleeping bag.

It is a still further important and primary object of the present invention to provide a sleeping bag with a pocket at the head thereof for sanitarily housing a pillow.

These and other objects, features and many of the attendant advantages of this invention will be appreciated more readily as the subject invention becomes better understood by reference to the following detailed description, when considered in connection with the accompanying drawings, wherein like parts in each of the several figures are identified by the same reference character, and wherein:

BRIEF DESCRIPTION OF THE DRAWINGS

FIG. 1 is a perspective view of the sleeping bag embodying the present invention.

FIG. 2 is a partial sectional view taken along Plane 2 — 2 of FIG. 1.

FIG. 3 is an expanded view of the sleeping bag embodying the instant invention.

FIG. 4 is a partial sectional view taken along Plane 4 — 4 of FIG. 3.

FIG. 5 is a fragmentary expanded perspective view of the head portion of the present invention depicting an alternative embodiment thereof.

DESCRIPTION OF THE PREFERRED EMBODIMENT

With continuing reference now to the drawings, and more particularly now to FIG. 1, the preferred embodiment of the sleeping bag of the present invention is generally indicated at 9 comprising a generally rectangularly-shaped, elongated unitary sheet 10 of flexibly-foldable fabric material having a base portion 11, a cover portion 12, a head portion, generally indicated at 13, with a pocket 14 for a pillow and a bag portion 15 with an extensible and expandable foot portion generally shown at 16.

With special emphasis now on FIG. 3, it is clearly shown and illustrated that the sleeping bag 9 may be economically and conveniently constructed of a single, unitary sheet 10 of fabric.

However, it should be noted at this time that the construction of the present invention should not in any way be limited to the use of a single unitary sheet of fabric. A plurality of sheets could, if desired, be utilized with equally acceptable results. Further, the present invention could also be fabricated of other foldably flexible materials other than the "fabric sheets" described herein, such as the envelope structure filled with kapok or other yielding resilient material described in U.S. Pat. No. 2,594,438.

The sheet 10 is generally rectangularly shaped. The head portion 13 includes a pocket portion 14 formed by folding the upper end 17 of the sheet 10 medially its length and transversely of the elongated sheet 10, thereby functionally dividing the sheet 10 into a base portion 11 and a top portion 18 formed by the upper end 17 and the sheeting material adjacent thereto. The top portion 18 is superposed over a fractional section of the base portion 11. The marginal edges 19 along the sides of the top portion 18 of the sheet 10 are seamed, typically by sewing, to the corresponding marginal edges 20 of the superposed fractional section of the base portion 11 disposed therebeneath, thereby forming a pocket 14 for a pillow 21 (shown in phantom lines in FIG. 1).

The edge 22 of the upper end 17 disposed transversely to the base portion 11 of the elongated sheet 10 is seamed to improved the durability and wearing characteristics of the edge 22 and to prevent unraveling of the fabric by folding the free end 23 back upon the body 24 of the fabric and sewing it thereto as shown at 25 in FIG. 4.

The pillow pocket 14 thus formed permits a pillow, such as shown in FIG. 1 and identified at 21, to be slipped thereinto to sanitarily protect the pillow 21 when the person using the sleeping bag places his head thereupon. Preferrably speaking, the entrance or opening to the pocket 14 should face the intermediate base portion 11 of the sleeping bag 9 to permit the person to place his hand under the pillow 21 while sleeping or resting. This is a favorite sleeping or resting position of many people.

Another embodiment of the pillow pocket 14 is shown in FIG. 5. To ensure sanitation of the pillow 21 in the event that the pillow 21 does not have its own independent fabric covering or so-called "pillowcase", an inside flap 26 is provided which is tucked under the pillow. With the inside flap 26 in position, the pillow 21 is protected from the hand and arm of the person using the sleeping bag if the person should sleep or rest with his head upon the pillow 21 and his hand and/or arm placed therebeneath as is the habit of many persons.

Referring once again to FIG. 3, a cover portion 12 is created by folding the bottom end 27 of the sheet 10 medially its length and transversely of the elongated sheet 10, thereby functionally dividing the sheet 10 into a base portion 11 and a cover portion 12. The cover portion is superposed over a fractional section of the base portion 11; that fractional section being more than one-half of the base portion 11. Thereafterwards, the foot portion 16 which is divided intermediately by the fold at 28 created by superposing the cover portion 12 over the base portion 11, is directed inwardly inbetween the cover portion 12 and the base portion 11 and inverting the fold at 28 to thereby create an accordian fold comprising folds 28, 29 and 30 and generally indicated at 31. Following the creation of the accordian fold 31, the marginal edges 32 of the cover portion 12 along the sides thereof are seamed, typically by sewing, to the corresponding marginal edges 33 of the fractional section of the base portion 11 over which the cover portion 12 is superposed, but only extending from the foot portion 16, and more specifically, from the folds 29 and 30 up to points along the length of the elongated sheet 10 which are less than one-half of the length of the base portion 11 to improve access and egress.

As a result, a bag portion 15 is created with an extensible and expandable foot portion 16. The accordian fold 31 permits the feet of the sleeping bag user to be fully enveloped and contained with the foot portion 16 of the bag portion 15 but without constriction thereof. Further, it serves to accomodate a taller person; a person who is height is greater than the length of the base portion 11 of the sleeping bag 9.

Still further, by seaming the free edge 34 of the cover portion 12 disposed transversely to the base portion 11 of the elongated sheet 10, typically by folding the free end back upon the body of the fabric and sewing it thereto similar to that shown in FIG. 4, the durability and wearing characteristics of the edge 34 is markedly improved and unraveling of the fabric prevented.

With particular emphasis now on FIGS. 1 and 2, in order to further improve the durability and wearing characteristics of the seamed side portions; namely: 19,20 and 32,33, an elongated, narrow strip of fabric 35 is folded about and over each side of these joined edges 19,20 and 32,33 and, thereafterwards, sewed to the sheet 10 material forming said edges. Further, such fabric 35 is also sewn along the side edges of the head portion of the cover portion 12 above the bag portion 15, for the same reasons and purposes as hereinbefore discussed and described.

Turning now again to FIG. 1, tie tapes 36,37 are sewn along the side edges of the sheet 10. Typically, tie tapes 36 are secured to the head portion of the cover portion 12 above the bag portion 15 and complementary tie tapes 37 are sewn to the edges 20 thereby securing tie tapes 37 to the base portion 11 of the sleeping bag 9. In use, only one pair of tie tapes 36,37 are tied to each other to removably secure the cover portion 12 to the base portion 11 to prevent access and egress therefrom and to assist in maintaining the head portion of the cover portion 12 above the bag portion 15 about the upper torso of the person using the sleeping bag 9.

A further feature of the present invention is that it is conveniently adaptable for temporary securement to a mattress, shown in phantom at 8. Such securement of the sleeping bag 9 to the mattress 8 is accomplished by the means of stretchable tapes 38 anchored, by sewing, to the sheet 10 diagonally across each of the four corners 39 and arranged on the underside of the base portion 11.

While I have illustrated and described the preferred form of construction for carrying the invention into effect, it is, nevertheless, capable of variation and modification without departing from the spirit and scope of the invention. I, therefore, do not wish to be limited to the precise details of the invention disclosed herein, but desire to avail myself of such variations and modifications as fall within the scope of the claims appended hereto.

What is claimed is:

1. A one piece sheet forming a sleeping bag comprising:

(a) a bag portion having a cover portion and a base portion, the bag portion extending along less than one-half the length of the sleeping bag and having an opening therein in the upper portion thereof;

(b) a head portion having a pocket for containing a pillow therein wherein the pocket for containing the pillow is directly and oppositely disposed facing the opening of the bag and further includes a flap of sheet material extending from the edge of the pocket and substantially equal in length and width to the pocket whereby when the pillow is placed in the pocket the flap may be folded thereunder to protect the pillow from direct contact by the person using the sleeping bag when the person places any portion of his arm into the area beneath the pillow in the pocket;

(c) a foot portion formed as the bottom of the bag portion, including means for allowing the foot portion of the bag portion to be longitudinally extensible and laterally expandable to accomodate persons of various heights and to loosely contain the feet of the person using the sleeping bag; and (d) means for removably securing the sleeping bag to a mattress, wherein the means for removably securing the sleeping bag to a mattress includes elastic tapes diagonally disposed across each of the four corners of the sleeping bag beneath the base portion, the ends of the tapes being secured to the longitudinal and transverse edges of the base portion adjacently disposed to one another and cooperatively forming each of the respective corners of the base portion, wherein said sleeping bag is formed from a single, unitary sheet of foldable fabric substantially rectangular in shape, in longitudinal marginal edges of the sheet being the sides of the sheet and the transverse edges and the sheet portions immediately adjacent thereto being the ends of the sheet, one of the ends serving as the upper end and the other of the ends serving as the lower end of the sheet, the upper end of the sheet being folded mediately its length and transversely of the elongated sheet and superposing the upper end of the sheet over a fractional section of the sheet thereby dividing this sheet portion into a base portion and a top portion so as to place the marginal edges along the side of the top portion in intimate abuttment to the marginal edges along the sides of a fractional length of the base portion but corresponding to the length of the marginal sides of the top portion and thereafterwards being seamed together along substantially one-half of this length to form said head portion having a pocket for slideably receiving and containing a pillow therein and thereafterwards permitting the placement of the unseamed portion of the top portion underneath the pillow to permit the user of the sleeping bag to place an arm under the pillow without directly contacting the pillow thereby maintaining the sanitary condition of the pillow and eliminating the need for a separate pillowcase therefor;

the lower end of the sheet being folded mediately its length and transversely of the elongated sheet and superposing the lower end of the sheet over a fractional section of the base portion, the superposition being greater than one-half the total length of the base portion to form a cover portion with respect to the base portion and a foot portion at the lower end of the sheet so as to place the marginal edges along the sides of the cover portion in intimate abuttment to the marginal edges along the sides of the fractional section superposed by the cover portion and thereafterwards inverting the fold along the foot portion and arranging the fold between the cover portion and the base portion and disposed transverse length thereof and thereafterwards placing the sides between the fold and lower end of the sheet in intimate abuttment to form an accordian fold whereby the foot portion is longitudinally extensible and laterally expandable to accomodate persons of various heights substantially greater than the pre-extensible length of the sleeping bag, and then seaming the marginal edges thereof along less than one-half of the total length of the base portion, thereby forming a bag portion for containing the lower portion of the human body and having relatively easy ingress and egress thereinto.

* * * * *